US008881317B2

(12) United States Patent
Tokunaga

(10) Patent No.: US 8,881,317 B2
(45) Date of Patent: Nov. 11, 2014

(54) WARM TOILET SEAT

(75) Inventor: Tsukasa Tokunaga, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 252 days.

(21) Appl. No.: 13/599,404

(22) Filed: Aug. 30, 2012

(65) Prior Publication Data

US 2013/0074252 A1 Mar. 28, 2013

(30) Foreign Application Priority Data

Sep. 22, 2011 (JP) ..... 2011-207352

(51) Int. Cl.
*A47K 13/00* (2006.01)
*A47K 13/30* (2006.01)

(52) U.S. Cl.
CPC ..... *A47K 13/305* (2013.01)
USPC ..... 4/237

(58) Field of Classification Search
CPC ..... A47K 13/00
USPC ..... 4/234–241
See application file for complete search history.

(56) References Cited

U.S. PATENT DOCUMENTS 7,943,291 B2 5/2011 Tokunaga et al.
8,117,683 B2 * 2/2012 Yamamoto et al. ..... 4/237
8,418,272 B2 * 4/2013 Nishimura et al. ..... 4/237
8,769,729 B2 * 7/2014 Nishimura et al. ..... 4/234
2009/0025131 A1 * 1/2009 Yamamoto et al. ..... 4/420
2009/0324902 A1 12/2009 Tokunaga et al.
2010/0095443 A1 * 4/2010 Nishimura et al. ..... 4/237
2011/0089160 A1 4/2011 Kuriki
2013/0117920 A1 * 5/2013 Nishimura et al. ..... 4/237

FOREIGN PATENT DOCUMENTS

JP 08-078143 3/1996
JP 2006-122151 5/2006
JP 2010-3667 1/2010
JP 2010-029425 2/2010
JP 2010-63669 3/2010
JP 2010-165659 7/2010

OTHER PUBLICATIONS

Rejection of the Application issued Sep. 3, 2013 by the Japanese Patent Office in Japanese Patent Application No. 2011-207352, with partial English translation.

* cited by examiner

*Primary Examiner* — Lori Baker
(74) *Attorney, Agent, or Firm* — Young & Thompson

(57) ABSTRACT

A warm toilet seat contains a toilet seat having a seating surface and a transparent seat heater disposed on the seating surface, the seat heater contains a thin wiring structure having a pitch of 5000 μm or less and a heat transfer coefficient κ of 100 W/m·K or more, and a material having a heat transfer coefficient κ of 10 to 150 W/m·K is placed in an opening in the thin wiring structure.

22 Claims, 11 Drawing Sheets

PRIOR ART

WARM TOILET SEAT

CROSS-REFERENCE TO RELATED APPLICATION

This application is based upon and claims the benefit of priority from Japanese Patent Application No. 2011-207352 filed on Sep. 22, 2011, of which the contents are incorporated herein by reference.

BACKGROUND OF THE INVENTION

1. Field of the Invention

The present invention relates to a warm toilet seat suitable for forming a heat generator on a seating surface of the seat.

2. Description of the Related Art

In conventional warm toilet seats, one horseshoe-shaped sheet heating element is embedded in a seating portion of a horseshoe-shaped toilet seat composed of a synthetic resin (see Japanese Laid-Open Patent Publication Nos. 08-078143 and 2010-029425). In the sheet heating element, a heater cord, which is coated with a fluororesin insulation and has an outer diameter of 1 mm or less, is arranged in a continuous wiring pattern of connected long U shapes between one horseshoe-shaped metal foil sheet (such as an aluminum foil) and an adhesive tape.

Particularly in Japanese Laid-Open Patent Publication No. 2010-029425, separated right and left seat heaters are used in one current system. Therefore, a material for first and second metal foils can be effectively utilized to lower the cost, and the seat heaters can be easily attached to the seating surface reliably without adhesion defects such as wrinkling and gap formation.

SUMMARY OF THE INVENTION

However, the above-described conventional sheet heating element having the horseshoe-shaped heater unit structure is prepared by attaching the metal foil sheet to the toilet seat and then attaching the heater cord to the metal foil sheet with the adhesive tape, and thereby requires high cost and complicated processes.

Furthermore, though energy saving can be achieved by disposing the heating element on the seating surface of the toilet seat, the heating element cannot exhibit a uniform heating distribution and cannot be transparent due to the metal foil.

In view of the problems, an object of the present invention is to provide a warm toilet seat, which can be produced by a reduced number of attaching step with improved productivity and reduced cost and can exhibit uniform heating distribution and excellent energy saving property.

[1] A warm toilet seat according to a first aspect of the present invention comprises a toilet seat having a seating surface, and a transparent seat heater disposed on the seating surface, the seat heater contains a thin wiring structure having a pitch of 5000 μm or less and a heat transfer coefficient κ of 100 W/m·K or more, and a material having a heat transfer coefficient κ of 10 to 150 W/m·K is placed in an opening in the thin wiring structure.

Therefore, the conventionally required steps of attaching the metal foil sheet to the toilet seat and attaching the heater cord to the metal foil sheet with the adhesive tape can be omitted, and the seat heater can be disposed on the seating surface of the toilet seat in one attaching step. Furthermore, since the seat heater is disposed on the seating surface of the toilet seat, as compared with the case where it is disposed on the back surface of the toilet seat, a time required for heating the seating surface to a predetermined temperature can be significantly reduced. In addition, since the material having a heat transfer coefficient κ of 10 to 150 W/m·K is placed in the opening in the thin wiring structure, the generated heat can be rapidly transferred over the entire seating surface to improve the heating distribution.

[2] In the warm toilet seat according to the first aspect, the seat heater may be used as a heat generator for warming the toilet seat.

[3] In the warm toilet seat according to the first aspect, it is preferred that the seat heater has a light transmittance of 70% or more.

[4] In the warm toilet seat according to the first aspect, it is preferred that the seat heater contains a conductive film having the thin wiring structure and the conductive film is prepared by shaping and stretching to 110% or more an unshaped conductive film.

[5] In the warm toilet seat according to [4], the shaped conductive film may be placed on the seating surface of the toilet seat.

[6] In the warm toilet seat according to [4], the conductive film may be shaped and placed on the seating surface of the toilet seat by insert molding.

[7] In the warm toilet seat according to [4], the conductive film may be prepared by exposing and developing a photosensitive material, which has a support and a silver halide emulsion layer formed thereon and contains a conductive fine particle and a binder in the silver halide emulsion layer or a layer disposed at the silver halide emulsion layer side.

[8] In the warm toilet seat according to [7], it is preferred that the mass ratio of the conductive fine particle to the binder (the conductive fine particle/binder mass ratio) is 1/33 to 5.0/1.

[9] In the warm toilet seat according to [7], it is preferred that the application amount of the conductive fine particle is 10 $g/m^2$ or less.

[10] In the warm toilet seat according to [7], the photosensitive material may contain the conductive fine particle and the binder in a layer adjacent to the silver halide emulsion layer.

[11] A warm toilet seat according to a second aspect of the present invention comprises a toilet seat having a seating surface and a transparent seat heater disposed on the seating surface, the seat heater contains a thin wiring structure having a pitch of 5000 μm or less, and the thin wiring structure is divided into a plurality of regions by an electrical insulation.

[12] In the warm toilet seat according to the second aspect, it is preferred that the regions each have a shape corresponding to the shape of the seating surface and have the same or similar resistance values with a margin of ±15% or less between feeding electrodes.

[13] In the warm toilet seat according to the second aspect, the electrical insulation may be formed by laser-etching the thin wiring structure.

[14] In the warm toilet seat according to the second aspect, the thin wiring structure may be prepared by exposing and developing a photosensitive material having a support and a silver halide emulsion layer formed thereon, the thin wiring structure may be divided into the regions by laser etching, and the regions may have the same or similar resistance values with a margin of ±15% or less between feeding electrodes.

[15] In the warm toilet seat according to the second aspect, the electrical insulation may be formed in the process of preparing the thin wiring structure.

[16] In the warm toilet seat according to the second aspect, the electrical insulation may be formed by cutting a conductive film having a support and the thin wiring structure formed thereon.

[17] In the warm toilet seat according to the second aspect, the electrical insulation may be formed by making a hole in the thin wiring structure.

[18] In the warm toilet seat according to the second aspect, the thin wiring structure may be prepared by exposing and developing a photosensitive material having a support and a silver halide emulsion layer formed thereon, the thin wiring structure may be divided into the regions, and the regions may have the same or similar resistance values with a margin of ±15% or less between feeding electrodes.

[19] In the warm toilet seat according to the second aspect, the seat heater may be used as a heat generator for warming the toilet seat.

[20] In the warm toilet seat according to the second aspect, it is preferred that the seat heater has a light transmittance of 70% or more.

[21] In the warm toilet seat according to the second aspect, it is preferred that the seat heater contains a conductive film having the thin wiring structure and the conductive film is prepared by shaping and stretching to 110% or more an unshaped conductive film.

[22] In the warm toilet seat according to [21], the shaped conductive film may be placed on the seating surface of the toilet seat.

[23] In the warm toilet seat according to [21], the conductive film may be shaped and placed on the seating surface of the toilet seat by insert molding.

[24] A warm toilet seat according to a third aspect of the present invention comprises a toilet seat having a seating surface and a transparent seat heater disposed on the seating surface, and the seat heater contains a thin wiring structure having a pitch of 5000 μm or less and a heat transfer coefficient κ of 100 W/m·K or more.

[25] In the warm toilet seat according to the third aspect, the seat heater may contain a conductive film having the thin wiring structure, and the conductive film may be prepared by exposing and developing a photosensitive material having a support and a silver halide emulsion layer formed thereon.

[26] A warm toilet seat according to a fourth aspect of the present invention comprises a toilet seat having a seating surface and a transparent seat heater disposed on the seating surface, the seat heater contains a support and a conductive layer formed over the entire surface thereof, and the conductive layer has a heat transfer coefficient κ of 100 W/m·K or more.

[27] In the warm toilet seat according to the fourth aspect, the seat heater may contain a conductive film having the conductive layer, and the conductive film may be prepared by exposing and developing a photosensitive material having the support and a silver halide emulsion layer formed thereon.

The warm toilet seat of the present invention can be produced by a reduced number of attaching step with improved productivity and reduced cost. Furthermore, the warm toilet seat can exhibit uniform heating distribution and excellent energy saving property since the seat heater is placed on the seating surface of the toilet seat.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

An embodiment of the warm toilet seat of the present invention will be described below with reference to FIGS. 1 to 11. It should be noted that, in this description, a numeric range of "A to B" includes both the numeric values A and B as the lower and upper limit values.

First, a toilet seat apparatus 10 containing a warm toilet seat according to the embodiment will be described below with reference to FIGS. 1 and 2.

Figure 1:
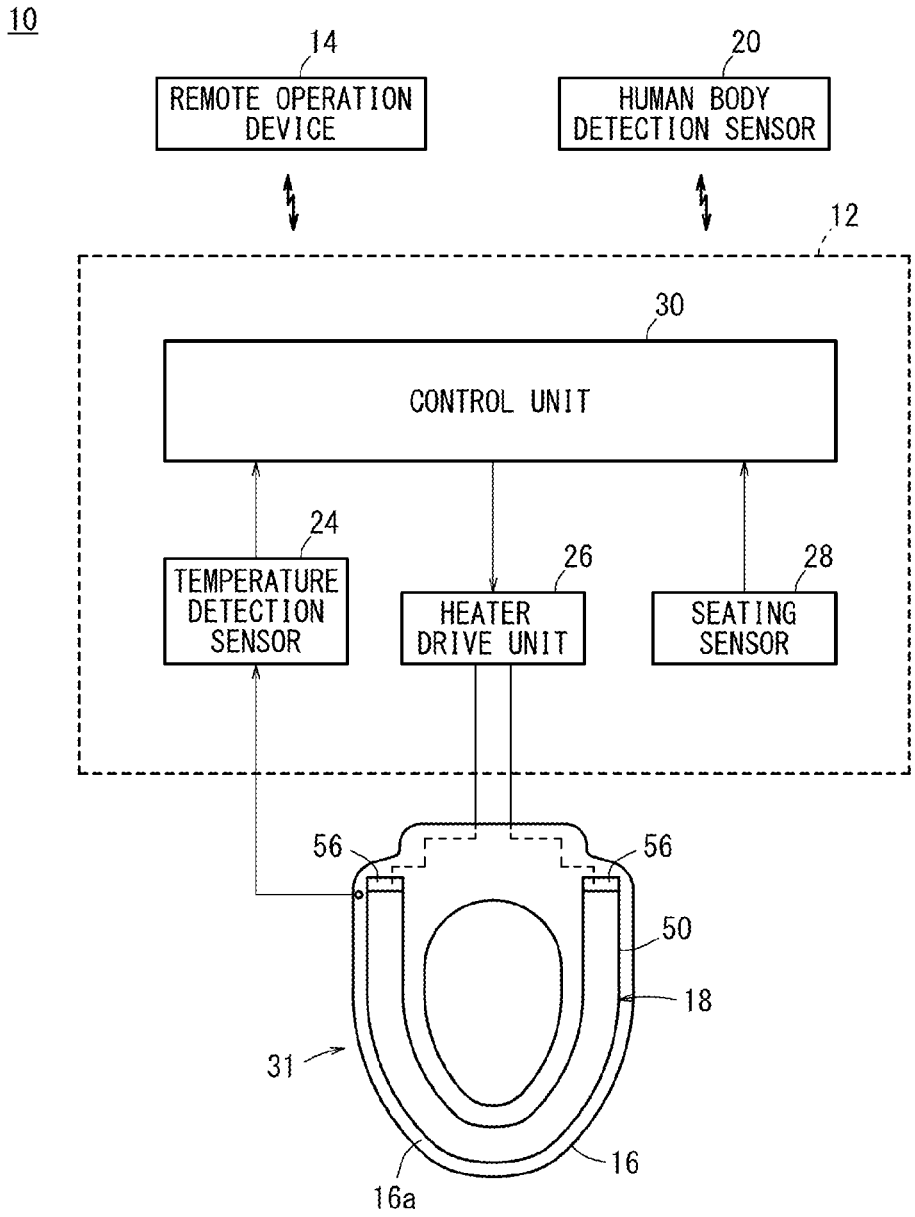
FIG. 1 is an overall structural view of a toilet seat apparatus containing a warm toilet seat according to an embodiment of the present invention.
Figure 2:
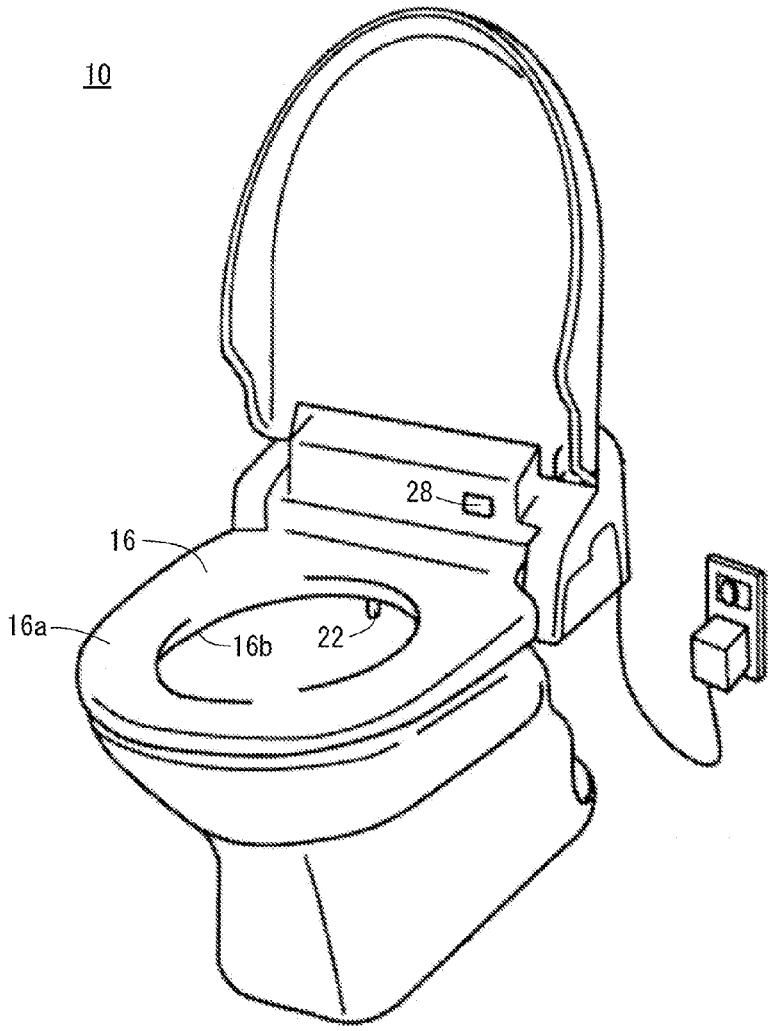
FIG. 2 is a perspective structural view of the toilet seat apparatus.

As shown in FIG. 1, the toilet seat apparatus 10 has a main body 12, a remote operation device 14 for remotely controlling the main body 12, a toilet seat 16 on which a user sits, a seat heater 18 disposed on a seating surface 16*a* of the toilet seat 16 as a heat generator for warming the toilet seat 16, and a human body detection sensor 20 for detecting a human body. A warm toilet seat 31 according to this embodiment contains at least the toilet seat 16 and the seat heater 18 disposed on the seating surface 16*a* thereof. As shown in FIG. 2, the toilet seat apparatus 10 further has a washing device 22 for washing an excretory of the user.

As shown in FIG. 1, the main body 12 contains a temperature detection sensor 24 for detecting the temperature of the toilet seat 16, a heater drive unit 26 for supplying an electric power to the seat heater 18, a seating sensor 28 for detecting the sitting of the user on the toilet seat 16, and a control unit 30 for controlling the components.

For example, the heater drive unit 26 is activated to control the temperature of the toilet seat 16 by the control unit 30 based on a temperature information from the temperature detection sensor 24. When the user does not sit on the toilet seat 16, the temperature of the toilet seat 16 is controlled at the default temperature. When the user sits on the toilet seat 16, the temperature of the toilet seat 16 is changed from the default temperature to a desired temperature (a preset temperature or a real-time set temperature).

The seat heater 18 contains a conductive film 50 having a conductive layer 63 as described below.

Four examples of the conductive films 50 (first to fourth conductive films 50A to 50D), usable in the seat heater 18 of the warm toilet seat 31 of this embodiment, will be specifically described below with reference to FIGS. 3A to 6B.

Figure 3A:
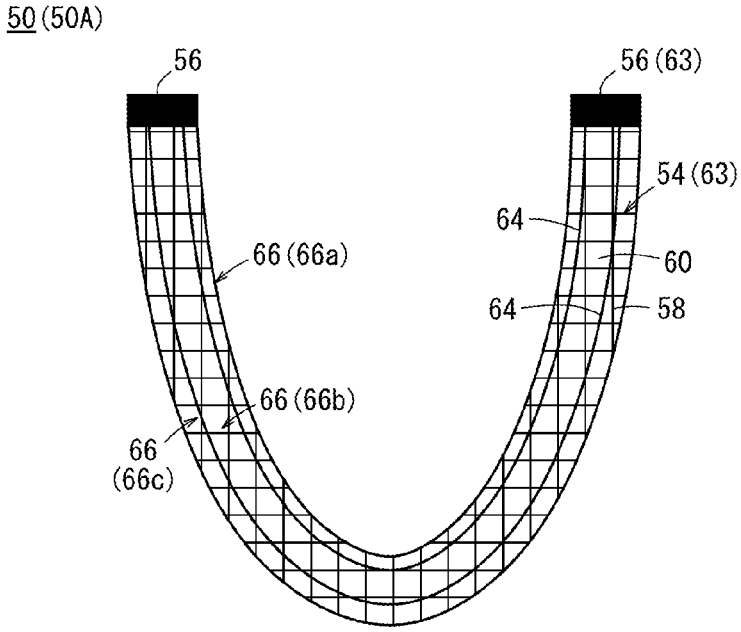
FIG. 3A is a view from above of a first conductive film.
Figure 3B:
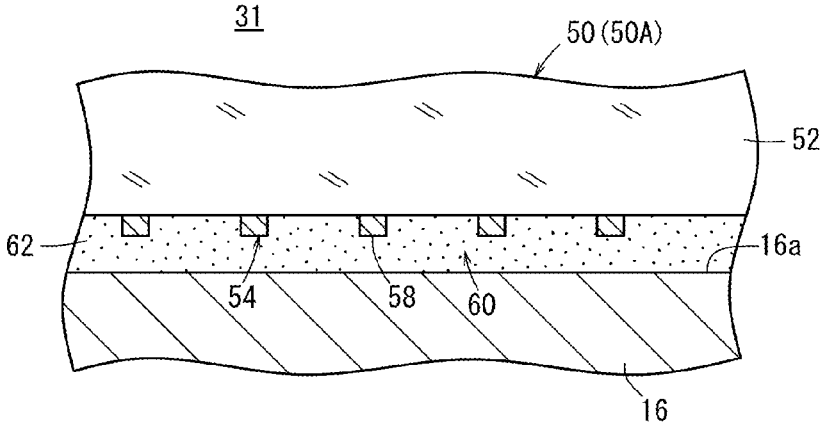
FIG. 3B is a partial cross-sectional view of the first conductive film attached to a seating surface of a toilet seat.

As shown in FIGS. 3A and 3B, the first conductive film 50A has a support 52, a thin wiring structure 54 composed of silver formed on the support 52, and electrodes 56 formed on both ends. The thin wiring structure 54 contains thin wires 58 composed of silver and a plurality of openings 60 surrounded by the thin wires 58. The arrangement pitch of the thin wires 58 is 5000 μm or less (preferably 3000 μm or less, more preferably 1000 μm or less, further preferably 500 μm or less). The light transmittance of the thin wiring structure 54 is 70% or more (preferably 75% or more, more preferably 80% or more, further preferably 83% or more). In this example, the conductive layer 63 is composed of the thin wiring structure 54 and the electrodes 56.

In the first conductive film 50A, the thin wiring structure 54 is divided by one or more electrical insulations 64 into a plurality of regions 66, which each have a shape corresponding to the toilet seat 16. In the example of FIG. 3A, the thin wiring structure 54 is divided by two electrical insulations 64 into three regions 66*a*, 66*b*, and 66*c*. The regions 66 have the same or similar resistance values between the electrodes 56 with a margin of ±15% or less (preferably ±10% or less, more preferably ±8% or less, further preferably ±5% or less). For example, the toilet seat 16 (particularly its outer periphery) has a U shape, and the electrical insulations 64 have homothetic or non-homothetic U shapes along the outer periphery. The shapes of the electrical insulations 64 may be modified to achieve the same or similar resistance values with a margin of ±15% or less in each of the regions 66. The electrical insulations 64 may be formed simultaneously with the thin wiring structure 54. Alternatively, the electrical insulations 64 may be formed by laser etching or the like after the formation of the thin wiring structure 54. Furthermore, for example, the electrical insulations 64 may be formed by cutting the first conductive film 50A into a plurality of pieces and by arranging the cut pieces at a distance from each other. In addition, the electrical insulations 64 may be formed by making a hole in the thin wiring structure 54 of the first conductive film 50A to break the wire.

The first conductive film 50A is attached to the seating surface 16*a* of the toilet seat 16 with an adhesive 62 or the like.

Figure 4A:
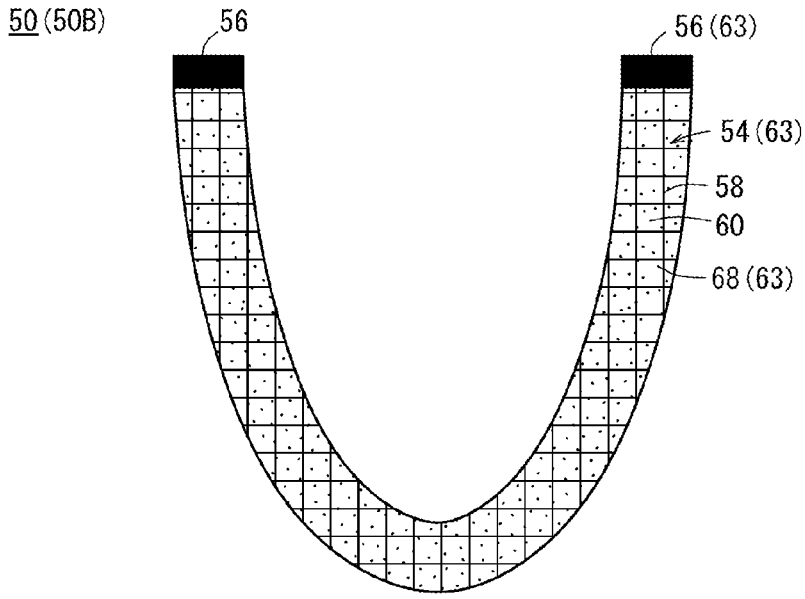
FIG. 4A is a view from above of a second conductive film.
Figure 4B:
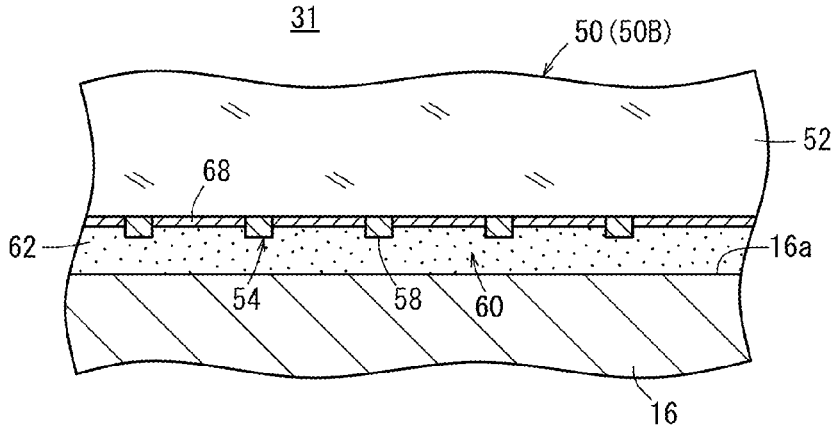
FIG. 4B is a partial cross-sectional view of the second conductive film attached to a back surface of a toilet seat.

As shown in FIGS. 4A and 4B, the second conductive film 50B has the support 52, the thin wiring structure 54 composed of silver formed on the support 52, and the electrodes 56 formed on both ends, as in the first conductive film 50A. The second conductive film 50B further contains a heat transfer material 68 in the openings 60 in the thin wiring structure 54. The heat transfer coefficient κ of the thin wiring structure 54 is 100 W/m·K or more (more preferably 150 W/m·K or more, further preferably 200 W/m·K or more, the upper limit being preferably 500 W/m·K), and the heat transfer coefficient κ of the heat transfer material 68 placed in the openings 60 is 10 to 150 W/m·K (more preferably 30 to 120 W/m·K, further preferably 50 to 100 W/m·K). The heat transfer material 68 contains a conductive fine particle or a conductive polymer. In this example, the conductive layer 63 is composed of the thin wiring structure 54, the electrodes 56, and the heat transfer material 68. Unlike the first conductive film 50A, the second conductive film 50B does not have the electrical insulations 64.

Figure 5A:
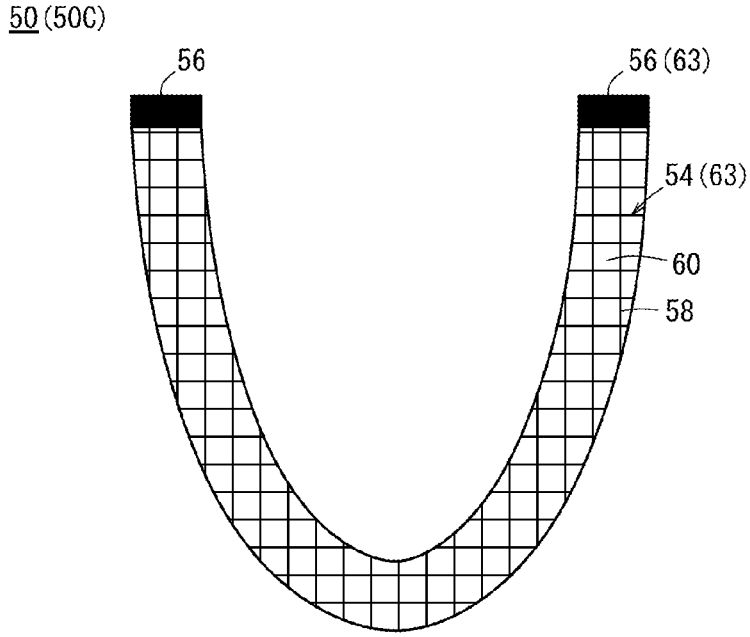
FIG. 5A is a view from above of a third conductive film.
Figure 5B:
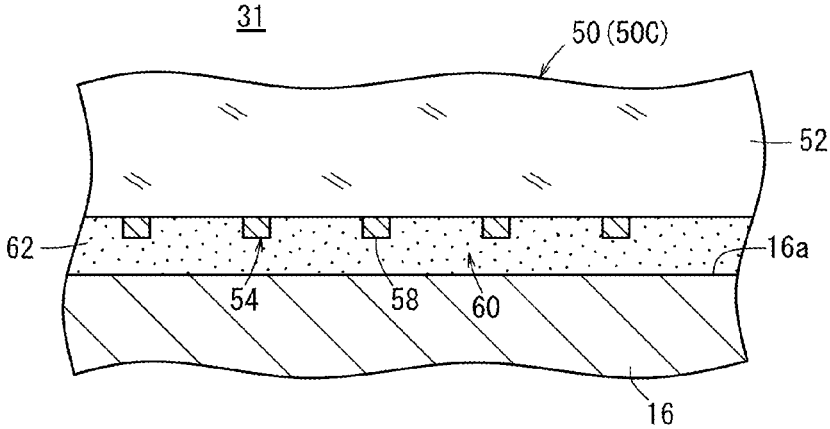
FIG. 5B is a partial cross-sectional view of the third conductive film attached to a seating surface of a toilet seat.

As shown in FIGS. 5A and 5B, the third conductive film 50C has approximately the same structure as the first conductive film 50A, but is different in that the electrical insulations 64 (see FIG. 3A) are not formed. The third conductive film 50C is inferior to the other example films in heating distribution. Therefore, a resin layer such as a protective layer or coating may be formed on the surface of the support 52 to obtain a uniform heating distribution.

Figure 6A:
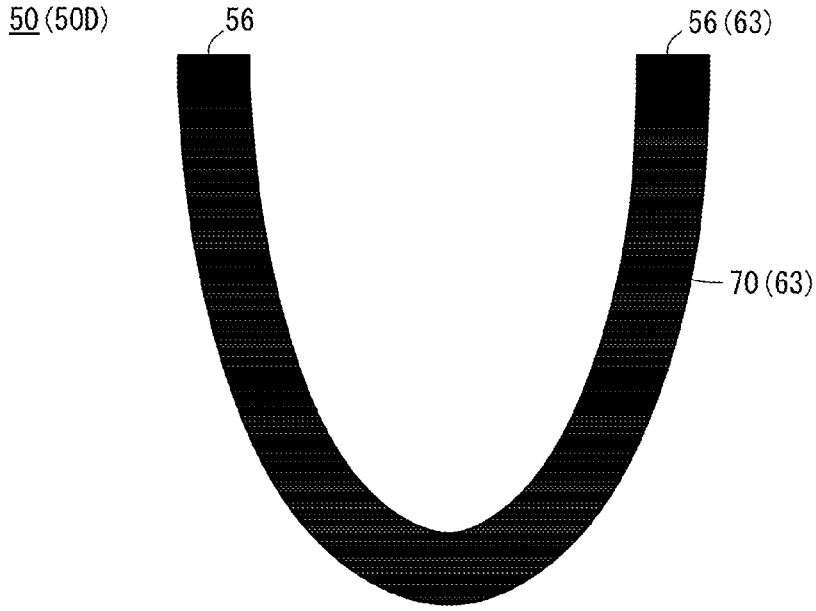
FIG. 6A is a view from above of a fourth conductive film.
Figure 6B:
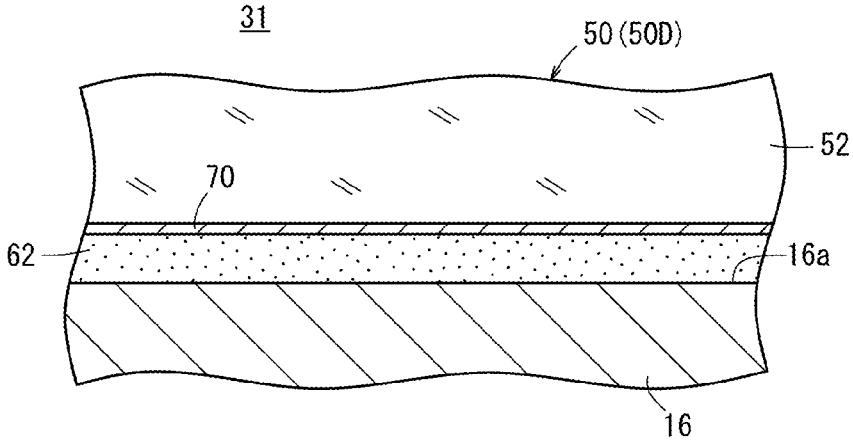
FIG. 6B is a partial cross-sectional view of the fourth conductive film attached to a back surface of a toilet seat.

As shown in FIGS. 6A and 6B, the fourth conductive film 50D has the support 52 and a layer 70 composed of silver formed over the entire surface of the support 52. The layer 70 contains the electrodes 56. In this example, the conductive layer 63 is composed of the entirely covering layer 70. The entirely covering layer 70 is not transparent, and therefore is not preferred from the viewpoint of appearance on the seating surface 16*a* of the toilet seat 16. Thus, the layer 70 may be coated with a paint to improve the appearance.

In the first to fourth conductive films 50A to 50D, the conductive layer 63 may be covered with a protective layer.

Then, a method for producing the warm toilet seat 31 of the embodiment will be described below. The warm toilet seat production methods include three production methods (first to third production methods) shown in FIGS. 7 to 11.

Figure 7:
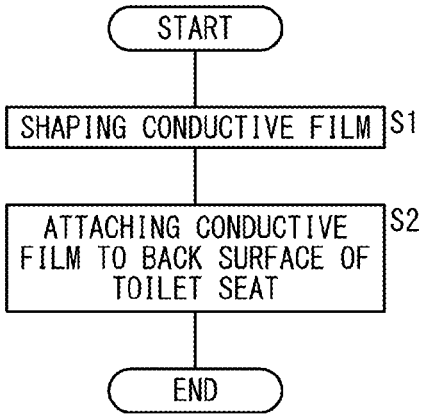
FIG. 7 is a flow chart of a first production method.
Figure 8A:
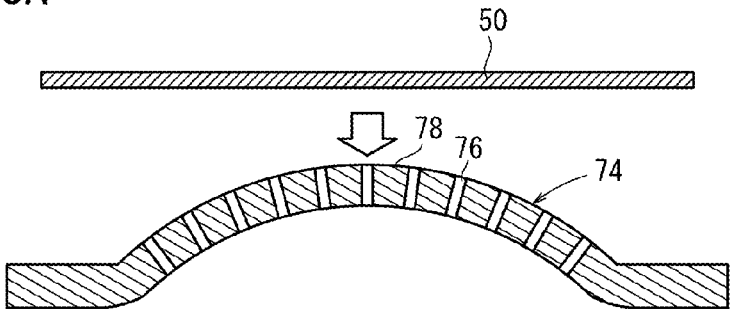
FIG. 8A is a partial cross-sectional view of a forming mold for vacuum molding of a conductive film.

In the first production method, in the step S1 of FIG. 7, the conductive film 50 (the conductive layer 63) is shaped under a load of 5 to 235 kg/cm$^2$. Specifically, as shown in FIG. 8A, the conductive film 50 is molded under vacuum into a curved surface shape corresponding to the seating surface shape of the toilet seat 16. In this method, the vacuum molding is carried out using a forming mold 74 having approximately the same dimension as an injection mold 72 for forming the toilet seat 16 (see FIG. 9). The mold shapes are exaggeratingly shown in FIGS. 8A, 8B, and 9. As shown in FIG. 8A, when the toilet seat 16 has a three-dimensional curved surface, the forming mold 74 has a similar curved surface (an inverted curved surface in this case) and a large number of vacuum vents 76. For example, when the toilet seat 16 has a concave curved surface, the forming mold 74 has such a dimension that a convex curved surface 78 thereof is fitted into the concave curved surface of the toilet seat 16.

Figure 8B:
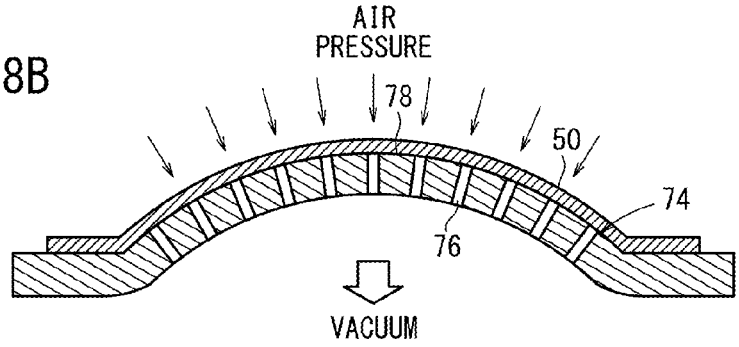
FIG. 8B is a cross-sectional view of the conductive film pressed to the forming mold.

The vacuum molding of the conductive film 50 may be carried out using the forming mold 74 as follows. As shown in FIG. 8A, the conductive film 50 is preheated at 110° C. to 300° C. Then, as shown in FIG. 8B, the conductive film 50 is pressed to the convex curved surface 78 of the forming mold 74, and an air pressure load of 5 to 235 kg/cm$^2$ is applied to the conductive film 50 by vacuuming air through the vacuum vents 76 in the forming mold 74. The conductive film 50 having the curved surface shape corresponding to the seating surface 16*a* of the toilet seat 16 is prepared by the vacuum molding.

Then, in the step S2 of FIG. 7, the shaped conductive film 50 is attached to the seating surface 16*a* of the toilet seat 16 with the adhesive 62 or the like to produce the warm toilet seat 31 (the toilet seat 16 equipped with the seat heater 18).

The second production method contains an insert molding step. In the step S101 of FIG. 10, as in the step S1 of the first production method, the conductive film 50 (the conductive layer 63) is shaped under a load of 5 to 235 kg/cm$^2$.

Figure 9:
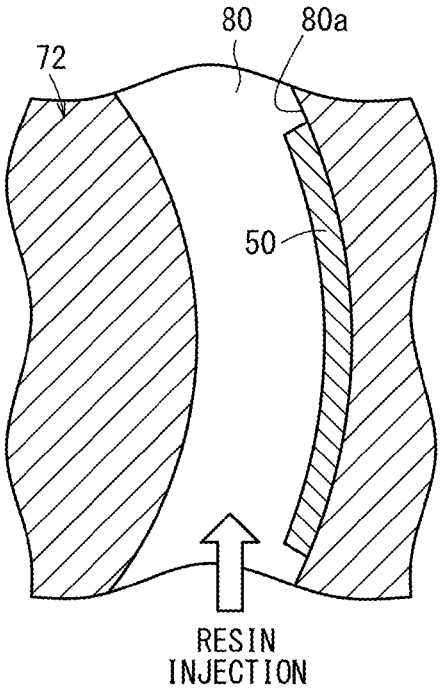
FIG. 9 is a partial cross-sectional view of the conductive film placed in an injection mold.
Figure 10:
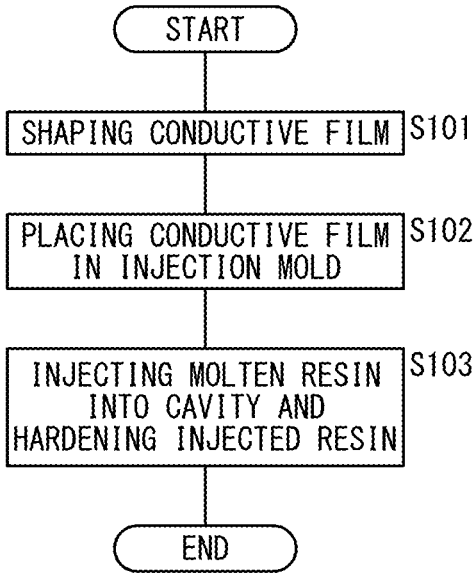
FIG. 10 is a flow chart of a second production method.
Figure 11:
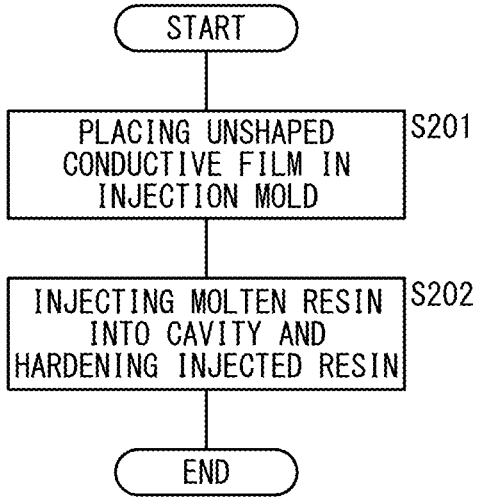
FIG. 11 is a flow chart of a third production method.

In the step S102, as shown in FIG. 9, the shaped conductive film 50 is placed in the injection mold 72. The conductive film 50 is placed in a cavity 80 of the injection mold 72 such that the conductive layer 63 or the protective layer formed thereon is brought into contact with a cavity surface 80*a* for molding the seating surface 16*a* of the toilet seat 16.

Then, in the step S103, a molten resin is introduced into the cavity 80 of the injection mold 72 and is hardened to obtain the toilet seat 16 having the seating surface 16*a* integrated with the conductive film 50. In this case, the conductive layer 63 is formed in direct contact with the seating surface 16*a* of the toilet seat 16 or with the protective layer interposed therebetween.

The third production method contains an insert molding step as in the second production method. In the step S201 of FIG. 11, unlike in the second production method, the unshaped conductive film 50 is placed in the injection mold 72.

Then, in the step S202, the molten resin is introduced into the cavity 80 of the injection mold 72 and is hardened to obtain the toilet seat 16 having the seating surface 16*a* integrated with the conductive film 50. In the injection molding (insert molding), it is preferred that the molten resin injection pressure or the like is controlled to shape the conductive film 50 under a load of 5 to 235 kg/cm$^2$.

In the first production method, the conventionally required steps of attaching the metal foil sheet to the toilet seat 16 and attaching the heater cord to the metal foil sheet with the adhesive tape can be omitted, and the conductive film 50 (the seat heater 18) can be placed on the seating surface 16*a* of the toilet seat 16 in one attaching step.

In the second production method, the toilet seat 16 integrated with the conductive film 50 can be obtained by the insert molding in the step of injecting the molten resin. Therefore, the step of attaching the seat heater 18 can be omitted, whereby the warm toilet seat production process can be simplified.

In the third production method, the step of shaping the conductive film 50 can be omitted before the injection molding, whereby the warm toilet seat production process can be simplified significantly.

[Heat Insulator]

In a case where the heat generator is located on the outer surface, the generated heat can be removed by the resin, resulting in poor efficiency. Thus, a heat insulator may be interposed between the conductive film as a heat generator and the seat resin to efficiently warm the outer surface. Examples of the heat insulators include fiber insulations (such as glass wools, rock wools, sheep wools, cellulose fibers, and carbonized corks) and foam insulations (such as urethane foams, polystyrene foams, EPS (bead method polystyrene or expanded polystyrene), and foamed rubbers (FEF, flexible elastomeric foam)). The heat insulator may be a PET foam or the like having a moldability similar to that of a PET used for the conductive film 50.

The above components of the conductive film 50 will be described below.

[Support]

The support 52 in the conductive film 50 may be a plastic film or plate, etc. Examples of materials for the plastic films and plates include polyesters such as polyethylene terephthalates (PET) and polyethylene naphthalates (PEN); polyolefins such as polyethylenes (PE), polypropylenes (PP), polystyrenes, and EVA; vinyl resins such as polyvinyl chlorides and polyvinylidene chlorides; polyether ether ketones (PEEK); polysulfones (PSF); polyether sulfones (PES); polycarbonates (PC); polyamides; polyimides; acrylic resins; and triacetyl celluloses (TAC). In a case where the conductive film 50 is required to have a transparency, the total visible light transmittance thereof is preferably 70% to 100%, more preferably 85% to 100%, further preferably 90% to 100%. In this case, the support 52 is preferably composed of the PET, PC, or acrylic resin. The PET is particularly preferred also from the viewpoint of workability. The support 52 may be colored depending on the intended use.

The plastic film or plate may have a monolayer structure or a multilayer structure containing two or more layers.

To strongly attach the conductive layer 63 to the support 52, the support 52 is preferably subjected beforehand to a surface activation treatment such as a chemical treatment, a mechanical treatment, a corona discharge treatment, a flame treatment, an ultraviolet treatment, a high-frequency treatment, a glow discharge treatment, an active plasma treatment, a laser treatment, a mixed acid treatment, or an ozone oxidation treatment.

For example, in a case where a silver halide emulsion layer formed on the support 52 is exposed and developed to form a metallic silver portion of the conductive layer 63 as described hereinafter, the adhesion (close contact) between the support 52 and the conductive layer 63 may be ensured by (1) subjecting the support 52 to the surface activation treatment and then forming the silver halide emulsion layer directly on the surface or (2) subjecting the support 52 to the surface activation treatment, forming an undercoat layer on the surface, and forming the silver halide emulsion layer on the undercoat layer. Particularly the method of (2) can further improve the close contact between the support 52 and the conductive layer 63.

The undercoat layer may have a monolayer structure or a multilayer structure containing two or more layers. The undercoat layer may contain a copolymer derived from a monomer selected from vinyl chloride, vinylidene chloride, butadiene, methacrylic acid, acrylic acid, itaconic acid, maleic anhydride, and the like, and may contain a polyethylenimine, an epoxy resin, a grafted gelatin, a nitrocellulose, or a gelatin. The undercoat layer preferably contains a gelatin. The undercoat layer may further contain resorcin or p-chlorophenol as a compound for swelling the support 52. If the undercoat layer contains the gelatin, the undercoat layer may further contain, as a gelatin hardener, a chromium salt (such as a chromium alum), an aldehyde (such as formaldehyde or glutaraldehyde), an isocyanate, an active halogen compound (such as 2,4-dichloro-6-hydroxy-S-triazine), an epichlorohydrin resin, an active vinyl sulfone compound, etc. In addition, the undercoat layer may contain, as a matting agent, $SiO_2$, $TiO_2$, an inorganic fine particle, or a fine polymethyl methacrylate copolymer particle.

[Conductive Layer]

As described above, the conductive film 50 contains the support 52 and the conductive layer 63 formed thereon. The conductive layer 63 may be formed on one or both sides of the support 52. The conductive layer 63 may be formed by disposing a silver salt emulsion layer containing a silver halide and a binder on the support 52 and by exposing and developing the emulsion layer in a desired pattern. As one example of the pattern, the conductive layer 63 having the thin wiring structure 54 can be formed by exposing and developing the emulsion layer in a mesh pattern with a large number of lattice intersections of the thin wires 58, so that the light transmittance of the conductive layer 63 can be improved. Alternatively, the conductive layer 63 may be formed by exposing and developing the entire surface of the emulsion layer.

The silver salt emulsion layer may contain a solvent and an additive such as a dye in addition to the silver halide and the binder. One, two, or more emulsion layers may be formed on the support 52. The thickness of the emulsion layer is preferably 0.05 to 20 μm, more preferably 0.1 to 10 μm.

(Silver Salt)

The silver salt emulsion layer contains the silver halide as the silver salt. The silver halide has an excellent light sensing property, and thus preferably used in this embodiment. Silver halide technologies for photographic silver salt films, photographic papers, print engraving films, emulsion masks for photomasking, and the like may be utilized in the embodiment.

The silver halide may contain a halogen element of chlorine, bromine, iodine, or fluorine, and may contain a combination of the elements. For example, the silver halide preferably contains AgCl, AgBr, or AgI as a main component. Also silver chlorobromide, silver iodochlorobromide, or silver iodobromide is preferably used as the main component. The term "the silver halide contains AgBr as the main component" means that the molar fraction of bromide ion is 50% or more in the silver halide composition. The silver halide particle containing AgBr as the main component may contain iodide or chloride ion in addition to the bromide ion. The silver halide containing a silver halide other than AgBr (such as AgCl or AgI) as the main component is interpreted in the same manner.

The amount of the silver halide in the silver salt emulsion layer is not particularly limited. The amount in the silver density (in terms of silver) is preferably 0.1 to 40 g/m$^2$, more preferably 0.5 to 25 g/m$^2$, further preferably 3 to 25 g/m$^2$, still further preferably 5 to 20 g/m$^2$, particularly preferably 7 to 15 g/m$^2$.

(Binder)

The binder is used in the silver salt emulsion layer to uniformly disperse the silver halide particles and to help the emulsion layer adhere to the support 52. The binder may contain a water-insoluble or water-soluble polymer, and preferably contains a water-soluble polymer. Specific examples of the binders include gelatins, polyvinyl alcohols (PVA), polyvinyl pyrolidones (PVP), polysaccharides such as starches, celluloses and derivatives thereof, polyethylene oxides, polysaccharides, polyvinylamines, chitosans, polylysines, polyacrylic acids, polyalginic acids, polyhyaluronic acids, and carboxycelluloses.

In this embodiment, the gelatin is preferably used as the binder in the silver salt emulsion layer.

The amount of the binder in the silver salt emulsion layer is not particularly limited, and is appropriately controlled in view of achieving satisfactory dispersion and adhesion properties. The silver (Ag)/binder volume ratio of the emulsion layer is preferably 1/1 to 4/1, more preferably 1.5/1 to 4/1. When the silver/binder volume ratio of the emulsion layer is within the above range, the breakage of the metallic silver portion can be more reliably prevented after the molding.

(Solvent)

The solvent used for forming the silver salt emulsion layer is not particularly limited, and examples thereof include water, organic solvents (e.g. alcohols such as methanol, ketones such as acetone, amides such as formamide, sulfoxides such as dimethyl sulfoxide, esters such as ethyl acetate, ethers), ionic liquids, and mixtures thereof.

The mass ratio of the solvent to the total 100 parts by mass of the other components in the silver salt emulsion layer is 30 to 90 parts by mass, preferably 50 to 80 parts by mass.

(Acrylic Latex)

The silver salt emulsion layer may contain an acrylic latex to improve the contact with the support 52. The acrylic latex may be a dispersion containing an aqueous medium and a polymer derived from at least one acrylic monomer selected from methyl acrylate, ethyl acrylate, ethyl methacrylate, methyl methacrylate, acetoxyethyl acrylate, and the like.

The latex/gelatin mass ratio of the silver salt emulsion layer is preferably 0.15/1 to 2.0/1, more preferably 0.5/1 to 1.0/1.

(Other Additives)

The silver salt emulsion layer may further contain various additives. Examples of the additives include thickeners, antioxidants, matting agents, lubricants, antistatics, nucleation accelerators, spectral sensitizing dyes, surfactants, antifoggants, film hardeners, and black pepper inhibitors.

[Protective Layer]

In the conductive film 50, the protective layer may be formed on the conductive layer 63. The conductive layer 63 can be further prevented from peeling from the conductive film 50 by forming the protective layer. The protective layer preferably contains a gelatin, a high-molecular polymer, or the like. The thickness of the protective layer is preferably 0.02 to 0.2 μm, more preferably 0.05 to 0.1 μm. The protective layer may be formed directly on the conductive layer 63 and may be formed on an undercoat layer on the conductive layer 63.

[Heat Transfer Material]

In the above-described second conductive film 50B, the heat transfer material 68 is placed in the openings 60 in the thin wiring structure 54. If the silver salt emulsion layer contains the heat transfer material 68 or if a layer containing the heat transfer material 68 is applied or printed on the emulsion layer, the heat transfer material 68 can be placed in the openings 60 in the thin wiring structure 54 by exposing and developing the emulsion layer. The layer containing the heat transfer material 68 preferably contains a conductive fine particle and a binder. The layer containing the heat transfer material 68 may be composed of the conductive fine particle and the binder. The mass ratio of the conductive fine particle to the binder (the conductive fine particle/binder mass ratio) is preferably 1/33 to 5.0/1, more preferably 1/3 to 3.0/1.

The layer containing the heat transfer material 68 may be uniformly formed and attached by a coating or printing process. A coater (such as a slide coater, a slot die coater, a curtain coater, a roll coater, a bar coater, or a gravure coater), a screen printer, or the like may be used in the coating or printing process.

(Conductive Fine Particle)

Examples of the components for the conductive fine particle include metal oxides (such as $SnO_2$, ZnO, $TiO_2$, $Al_2O_3$, $In_2O_3$, MgO, BaO, and $MoO_3$) and composite oxides thereof. Another atom may be added to the metal oxide. The metal oxide is preferably $SnO_2$, ZnO, $TiO_2$, $Al_2O_3$, $In_2O_3$, or MgO, particularly $SnO_2$. The $SnO_2$ is preferably doped with antimony, particularly preferably doped with 0.2 to 2.0 mol % of antimony. The shape of the conductive fine particle is not particularly limited, and may be a grain shape, a needle shape, etc. When the conductive fine particle has a spherical shape, the average particle diameter is preferably 0.085 to 0.12 μm. When the conductive fine particle has a needle shape, the average long axis length is preferably 0.2 to 20 μm and the average short axis length is preferably 0.01 to 0.02 μm.

In the case of using the conductive fine particle and the binder, the application amount of the conductive fine particle is preferably 0.05 to 10 g/m$^2$, more preferably 0.1 to 5 g/m$^2$, further preferably 0.1 to 2.0 g/m$^2$.

If the application amount of the conductive fine particle is more than the above upper limit, the layer cannot have practically sufficient transparency and cannot be suitably used in the film required to be transparent. Furthermore, when the application amount is more than the above upper limit, the conductive fine particle cannot be easily dispersed uniformly in the application, so that the resultant layer often has increased production defects. On the other hand, when the application amount is less than the lower limit, the layer tends to have an insufficient in-plane heat generation property.

In the layer containing the conductive fine particle for the heat transfer material 68, the binder is additionally used to bring the conductive fine particle into close contact with the support 52. The binder is preferably a water-soluble polymer. The binder may be selected from the above binder examples for the emulsion layer.

(Conductive Polymer)

In the case of using the heat transfer material 68, the heat transfer material 68 may contain a conductive polymer and an insulating polymer. For example, the layer containing the heat transfer material 68 may be composed of the conductive polymer and the insulating polymer. In this case, a first layer containing the conductive polymer and a second layer containing the insulating polymer as a main component may be stacked. The layer containing the heat transfer material 68 may contain a mixture of the conductive polymer and the insulating polymer. In such a structure, the amount of an expensive conductive polymer can be reduced, thereby reducing the price of the product. In the case of using the mixture of the conductive polymer and the insulating polymer, the conductive polymer may be blended with another binder at a conductive polymer/binder ratio of 10%/90% (conductive polymer/other binder). The conductive polymer content is preferably 50% or more, more preferably 70% or more, further preferably 80% or more, by mass.

If the mixture of the conductive polymer and the insulating polymer is used in the layer containing the heat transfer material 68, the conductive polymer may be uniformly distributed or spatially nonuniformly distributed. In the nonuniform distribution, it is preferred that the conductive polymer content is increased in the outer surface of the layer. If the first layer (containing the conductive polymer as the main component) and the second layer (containing the insulating polymer as the main component) are stacked, it is preferred that the second layer is thicker than the first layer from the viewpoint of price reduction.

The conductive polymer is preferably high in light transmittance and conductivity, and preferred examples thereof include electron-conductive polymers such as polythiophenes, polypyrroles, and polyanilines.

The electron-conductive polymer may be a polymer known in the art such as a polyacetylene, a polypyrrole, a polyaniline, or a polythiophene. The electron-conductive polymer is described in detail in, for example, "*Advances in Synthetic Metals*", ed. P. Bernier, S. Lefrant, and G. Bidan, Elsevier, 1999; "*Intrinsically Conducting Polymers: An Emerging Technology*", Kluwer (1993); "*Conducting Polymer Fundamentals and Applications, A Practical Approach*", P. Chandrasekhar, Kluwer, 1999; and "*Handbook of Organic Conducting Molecules and Polymers*", Ed. Walwa, Vol. 1-4, Marcel Dekker Inc. (1997). Those skilled in the art will readily appreciate that also novel electron-conductive polymers to be developed in future can be used in the present invention. The electron-conductive polymer may be used singly or as a blend of a plurality of the polymers.

The insulating polymer may be an acrylic resin, an ester resin, a urethane resin, a vinyl resin, a polyvinyl alcohol, a polyvinyl pyrrolidone, a gelatin, etc, and is preferably an acrylic resin or a polyurethane resin, particularly an acrylic resin.

Then, the preparation of the conductive film 50 will be described below.

[Preparation of Conductive Film]

The conductive film 50 may be prepared by exposing and developing the silver salt emulsion layer on the support 52 in a desired pattern to form the conductive layer 63 containing the metallic silver portion with a desired shape.

If the thin wiring structure 54 is formed on the support 52, it is preferred that a mesh lattice pattern of straight lines crossed approximately perpendicularly or a mesh lattice pattern of wavy lines with at least one curve between the intersections in the conductive portion is formed by the exposure and development treatments. In a case where the conductive layer 63 has a mesh-patterned metallic silver portion, the pitch of the mesh pattern (the total of the line width of the metallic silver portion and the width of the opening) is not particularly limited and is preferably 5000 μm or less.

(Pattern Exposure)

The silver salt emulsion layer may be exposed in a pattern by a surface exposure method using a photomask or a scanning exposure method using a laser beam. In the methods, a refractive exposure process using a lens or a reflective exposure process using a reflecting mirror may be used, and various exposure treatments such as contact exposure, proximity exposure, reduced projection exposure, and reflective projection exposure treatments may be carried out.

(Development Treatment)

The silver salt emulsion layer is subjected to the development treatment after the exposure. Common development treatment technologies for photographic silver salt films, photographic papers, print engraving films, emulsion masks for photomasking, and the like may be used in the present invention.

In this embodiment, by the exposure and development treatments, the conductive portion (the metallic silver portion) is formed in the exposed area, and the opening (the light-transmitting portion) is formed in the unexposed area. The process of developing the emulsion layer may include a fixation treatment for removing the silver salt in the unexposed area to stabilize the layer. Fixation treatment technologies for photographic silver salt films, photographic papers, print engraving films, emulsion masks for photomasking, and the like may be used for the emulsion layer in the present invention.

(Laser Etching)

A portion to be converted to the electrical insulation 64 in the conductive layer 63 of the conductive film 50 may be irradiated with a laser light to selectively remove the metal from the portion. It is particularly important to appropriately select the laser wavelength used in the irradiation. If the laser wavelength is 400 nm or more (preferably 500 nm or more), the conductive layer 63 can be etched without damaging the support 52. The laser light emitted to the conductive layer 63 may be a YAG laser, a carbon dioxide laser, etc. The emission of the laser light to the conductive layer 63 may be carried out using a laser irradiation apparatus having a computerized XY-direction scanning mechanism. In this case, for example, the electrical insulation 64 may be formed in the conductive layer 63 by inputting a preset information on the pattern of the electrical insulation 64 into a computer memory via off-line teaching, reading the pattern information from the memory at the start of driving the laser irradiation apparatus, and irradiating the conductive layer 63 with the laser light while controlling the scanning mechanism based on the read information.

In a case where the electrical insulation 64 is formed by this laser etching, the conductive layer 63 preferably has a thickness of 5 μm or less. If the thickness is excessively large, the output of the laser light has to be increased for the etching, whereby the support 52 may be damaged by the laser light.

The resistance of the heat generator may be controlled by printing or applying a conductive paste or by attaching a metal foil tape on a high-resistance portion. A feeder for applying a voltage is needed to generate heat. The feeder may be formed by printing or applying a conductive paste such as a silver paste or by attaching a metal foil tape. It is preferred that the surface resistance R1 of the feeding electrode (the electrode 56) and the surface resistance R2 of the heat generator surface satisfy R2/R1>5 or more.

The production of the conductive film 50 may be appropriately combined with technologies described in the following patent publications and international patent pamphlets shown in Tables 1 and 2. The terms "Japanese Laid-Open Patent", "Publication No.", "Pamphlet No.", etc. are omitted.

TABLE 1

| | | | | |
|---|---|---|---|---|
| 2004-221564 | 2004-221565 | 2007-200922 | 2006-352073 | 2007-129205 |
| 2007-235115 | 2007-207987 | 2006-012935 | 2006-010795 | 2006-228469 |
| 2006-332459 | 2009-21153 | 2007-226215 | 2006-261315 | 2007-072171 |
| 2007-102200 | 2006-228473 | 2006-269795 | 2006-269795 | 2006-324203 |
| 2006-228478 | 2006-228836 | 2007-009326 | 2006-336090 | 2006-336099 |
| 2006-348351 | 2007-270321 | 2007-270322 | 2007-201378 | 2007-335729 |
| 2007-134439 | 2007-149760 | 2007-208133 | 2007-178915 | 2007-334325 |
| 2007-310091 | 2007-116137 | 2007-088219 | 2007-207883 | 2007-013130 |
| 2005-302508 | 2008-218784 | 2008-227350 | 2008-227351 | 2008-244067 |
| 2008-267814 | 2008-270405 | 2008-277675 | 2008-277676 | 2008-282840 |
| 2008-283029 | 2008-288305 | 2008-288419 | 2008-300720 | 2008-300721 |
| 2009-4213 | 2009-10001 | 2009-16526 | 2009-21334 | 2009-26933 |
| 2008-147507 | 2008-159770 | 2008-159771 | 2008-171568 | 2008-198388 |
| 2008-218096 | 2008-218264 | 2008-224916 | 2008-235224 | 2008-235467 |
| 2008-241987 | 2008-251274 | 2008-251275 | 2008-252046 | 2008-277428 |

TABLE 2

| | | | | |
|---|---|---|---|---|
| 2006/001461 | 2006/088059 | 2006/098333 | 2006/098336 | 2006/098338 |
| 2006/098335 | 2006/098334 | 2007/001008 | | |

[Shaping]

In this embodiment, as described above, the conductive film 50 is shaped under a particular condition into a desired shape to obtain the final conductive film 50 used as the seat heater 18. The shaped conductive film 50 may have a two-dimensional shape (a flat plate shape) or a three-dimensional shape (a convexo-concave or curved surface shape). The conductive film 50 having the two-dimensional shape may be prepared by stretching (elongating) the unshaped conductive film 50 having the flat plate shape under particular temperature and load conditions in the direction parallel to the film surface. The conductive film 50 having the three-dimensional shape may be prepared by forming the unshaped conductive film 50 having the flat plate shape under particular temperature and load conditions into a shape of a curved surface, a cuboid, a button, a cylinder, a combination thereof, etc.

The unshaped conductive film 50 may be formed into the two-dimensional shape under the particular temperature and load conditions by stretch forming, vacuum forming, pressure forming, hot press forming, etc. A forming apparatus such as a universal material testing instrument TENSILON (manufactured by A&D Co., Ltd.) may be used in this process.

The unshaped conductive film 50 may be formed into the three-dimensional shape under the particular temperature and load conditions by vacuum forming, pressure forming, hot press forming, etc. A forming apparatus such as an ultra-compact vacuum forming machine FVS-500 (manufactured by Wakisaka Engineering Co., Ltd.) may be used in this process.

In the production method of this embodiment, the unshaped conductive film 50 is shaped at a temperature of 110° C. to 300° C. The temperature is preferably 120° C. to 280° C., more preferably 130° C. to 250° C., further preferably 140° C. to 240° C., particularly preferably 150° C. to 220° C. Thus, the forming temperature of the conductive film 50 is preferably higher than a commonly-used resin forming temperature. If the temperature is excessively low, the conductive film 50 is not sufficiently softened, the desired shape is hardly obtained, and the conductivity is often deteriorated in the forming step. On the other hand, if the temperature is excessively high, the conductive film 50 is disadvantageously melted. The temperature is a preset temperature of a forming apparatus, i.e. an atmospheric temperature in the forming step.

In the production method of this embodiment, the conductive film 50 is shaped under a load of 5 to 235 kg/cm$^2$. The load is preferably 10 to 150 kg/cm$^2$, more preferably 15 to 50 kg/cm$^2$. Thus, the forming load of the conductive film 50 is preferably larger than a commonly-used resin forming load. If the load is excessively small, it is difficult to form the conductive film 50 into the desired shape. On the other hand, if the load is excessively large, the film and the conductive layer may be broken.

The load means a weight applied per a unit area of the conductive film 50 in the shaping step. Thus, in the stretch forming of the conductive film 50, the load is a tensile strength applied to the unit area of a cross section perpendicular to the tensile direction of the conductive film 50. In the vacuum forming, the load is a pressure applied to the unit area of the conductive film 50 under vacuum. In the pressure forming, the load is an air pressure applied to the unit area of the conductive film 50.

In the production method of this embodiment, in the shaping step, the unshaped conductive film 50 may be stretched preferably to 110% or more, more preferably to 115% or more, further preferably 130% or more, to prepare the final conductive film 50. When the shaping is carried out under the above temperature and load conditions, the conductive film 50 can be stretched to 110% or more while preventing the breakage of the metallic silver portion. In general, the metallic silver portion in the conductive layer 63 may be broken if the conductive film 50 is stretched to 110% or more. In contrast, under the above temperature and load conditions, the metallic silver portion in the conductive layer 63 is hardly broken even if the conductive film 50 is stretched to 110% or more. Thus, by performing the shaping step under the above temperature and load conditions, the flexibly of forming the conductive film 50 can be improved to expand the shape design possibility of the conductive film 50 as compared with conventional processes.

The upper limit of the stretch ratio of the conductive film 50 is not particularly limited. If the conductive film 50 is stretched at a stretch ratio of 250% or less (preferably 200% or less), the breakage of the metallic silver portion in the conductive layer 63 can be prevented more reliably.

The term "the conductive film 50 is stretched to 110% or more (stretched at a stretch ratio of 110% or more)" means that the conductive film 50 is stretched at the highest stretch ratio in a particular direction, the shortest length of the line extending in the particular direction along the surface of the stretched conductive film 50 (connecting both ends of the surface) is 110% or more, while the shortest length of the line extending in the corresponding direction along the surface of the unshaped conductive film 50 (connecting both ends of the surface) is 100%.

In the production method of this embodiment, the stretch speed in the shaping step is preferably 1000 mm/min or less, more preferably 50 to 1000 mm/min, further preferably 50 to 300 mm/min. The stretch speed means the speed of stretching the surface of the conductive film 50 in the particular direction (in which the conductive film 50 is stretched at the highest stretch ratio). If the stretch speed is excessively high, the metallic silver portion in the conductive layer 63 is easily broken. If the stretch speed is excessively low, it is difficult to shape the conductive film 50 into a desired shape, and the productivity is deteriorated.

It is preferred that the conductive film 50 is stretched at a constant stretch speed.

In the production method of this embodiment, the stretch ratio Y and the shaping temperature X (° C.) in the shaping step preferably satisfy the following inequality (I):

$$Y \leq 0.0081X + 0.4286$$

in which X is 80 to 230.

If the conductive film 50 is shaped under the condition of the inequality (I), the breakage of the conductive layer 63 can be further prevented.

The stretch ratio Y and the shaping speed Z (mm/min) in the shaping step preferably satisfy the following inequality (II):

$$Y \leq -0.0006Z + 2.3494$$

in which Z is 50 to 1000.

If the conductive film 50 is shaped under the condition of the inequality (II), the breakage of the conductive layer 63 can be further prevented.

In the production method of this embodiment, the shaping step is preferably carried out in an atmosphere having a relative humidity of 70% or more. The relative humidity is more preferably 80% to 95%. If the conductive film 50 is shaped under such a relative humidity, the binder of the water-soluble polymer (such as a gelatin) is swelled, whereby the conductive film 50 can be easily stretched.

In this embodiment, the surface resistivity R1 (ohm/sq (□)) of the conductive film 50 before stretched and the surface resistivity R2 (ohm/sq) of the conductive film 50 after stretched preferably satisfy the relation of R2/R1<3, more preferably satisfy the relation of R2/R1<2. It is preferred that the condition of R2/R1 is satisfied even in the case of stretching the conductive film 50 to 110%, 115%, 120%, 140%, 160%, 180%, 200%, etc.

The surface resistivity R2 is preferably 50 ohm/sq or less, more preferably 0.01 to 50 ohm/sq, further preferably 0.1 to 30 ohm/sq, particularly preferably 0.1 to 10 ohm/sq.

In this embodiment, a vapor treatment, a calender treatment, and a xenon irradiation treatment are preferably carried out to improve the conductivity and formability.

<Xenon Irradiation>

The metallic silver portion may be irradiated with a pulsed light from a xenon flash lamp after the development treatment. The irradiance level per one pulse is preferably 1 to 1500 J, more preferably 100 to 1000 J, further preferably 500 to 800 J. The irradiance level can be measured using a common ultraviolet intensity meter. The ultraviolet intensity meter may have a detection peak within a range of 300 to 400 nm.

Examples of the lights to be emitted to the metallic silver portion include ultraviolet, electron beam, X-ray, gamma ray, and infrared radiations. The ultraviolet is preferred from the viewpoint of versatility. A light source for the ultraviolet irradiation is not particularly limited, and examples thereof include high-pressure mercury lamps, metal halide lamps, and flash lamps (such as xenon flash lamps). In this embodiment, the xenon flash lamp is preferred from the viewpoints of the versatility and the improvement in the conductivity and formability of the metallic silver portion. For example, the xenon flash lamp is available from Ushio Inc.

The pulsed light irradiation is preferably performed 1 to 50 times, more preferably performed 1 to 30 times.

The xenon irradiation treatment is carried out under a relative humidity of 5% or more in a hygrothermal atmosphere while controlling the humidity to prevent dew condensation. The reason for the improvement in the conductivity and formability is unclear. It is believed that the micromovement of at least part of the water-soluble binder is facilitated under the increased humidity, whereby bindings between the particles of the metal (the conductive material) are increased.

The relative humidity in the hygrothermal atmosphere is preferably 5% to 100%, more preferably 40% to 100%, further preferably 60% to 100%, particularly preferably 80% to 100%.

<Smoothing Treatment (Calender Treatment)>

The metallic silver portion may be subjected to a smoothing treatment after the development treatment. In the smoothing treatment, the bindings between the metal particles are increased in the metallic silver portion, whereby the conductivity and formability of the portion is significantly improved.

For example, the smoothing treatment may be carried out using a calender roll, generally a pair of rolls. The smoothing treatment using the calender roll is hereinafter referred to as the calender treatment.

The roll used in the calender treatment may be a metal roll or a plastic roll such as an epoxy, polyimide, polyamide, or polyimide-amide roll. Particularly in a case where the silver salt emulsion layer is formed on both sides, it is preferably treated with a pair of the metal rolls. In a case where the silver salt emulsion layer is formed only on one side, it may be treated with a combination of the metal roll and the plastic roll in view of preventing wrinkling. The lower limit of the line pressure is preferably 1960 N/cm (200 kgf/cm) or more, more preferably 2940 N/cm (300 kgf/cm) or more. The upper limit of the line pressure is preferably 6860 N/cm (700 kgf/cm) or less. The line pressure (load) means a force applied per 1 cm of the film to be calender-treated.

The temperature, at which the smoothing treatment such as the calender treatment using the calender roll is carried out, is preferably 10° C. (without temperature control) to 100° C. Though the preferred temperature range depends on the density and shape of the mesh or wiring metal pattern, the type of the binder, etc., the temperature is more preferably 10° C. (without temperature control) to 50° C. in general.

<Hot Water Treatment or Vapor Treatment>

After the meshed silver layer composed of the developed silver (the thin wiring structure 54) is formed on the support 52, it is preferred that the conductive element precursor is dipped in a warm or heated water in a hot water treatment or brought into contact with a water vapor in a vapor treatment. By the treatment, the conductivity and formability can be easily improved in a short time. It is considered that the water-soluble binder is partially removed in the treatment, whereby the bindings between particles of the developed silver (the conductive material) are increased.

The treatment may be carried out after the development treatment, and is preferably carried out after the smoothing treatment.

The temperature of the hot water used in the hot water treatment is preferably 60° C. to 100° C., more preferably 80° C. to 100° C. The temperature of the water vapor used in the vapor treatment is preferably 100° C. to 140° C. at 1 atm. The treatment time of the hot water or vapor treatment depends on the type of the water-soluble binder used. If the support has a size of 60 cm×1 m, the time is preferably about 10 seconds to 5 minutes, more preferably about 1 to 5 minutes.

FIRST EXAMPLE

In Comparative Example 1 and Examples 1 to 4, the temperature rise time, the resistance value between electrodes 56, the power consumption, the heating distribution, and the number of attaching steps were measured. In Examples 1 to 4, also the light transmittance was measured.

<Sample A>

[Preparation of Emulsion]

| Liquid 1 | |
|---|---|
| Water | 750 ml |
| Phthalated gelatin | 20 g |
| Sodium chloride | 3 g |
| 1,3-Dimethylimidazolidine-2-thione | 20 mg |
| Sodium benzenethiosulfonate | 10 mg |
| Citric acid | 0.7 g |
| **Liquid 2** | |
| Water | 300 ml |
| Silver nitrate | 150 g |
| **Liquid 3** | |
| Water | 300 ml |
| Sodium chloride | 38 g |
| Potassium bromide | 32 g |
| Potassium hexachloroiridate (III) (0.005% KCl, 20% aqueous solution) | 5 ml |
| Ammonium hexachlororhodate (0.001% NaCl, 20% aqueous solution) | 7 ml |

The potassium hexachloroiridate (III) (0.005% KCl, 20% aqueous solution) and the ammonium hexachlororhodate (0.001% NaCl, 20% aqueous solution) in Liquid 3 were prepared by dissolving a complex powder in a 20% aqueous solution of KCl or NaCl and by heating the resultant solution at 40° C. for 120 minutes each.

Liquid 1 was maintained at 38° C. and pH 4.5, and 90% of Liquids 2 and 3 were simultaneously added to Liquid 1 over 20 minutes under stirring to form 0.16-μm nuclear particles. Then, Liquids 4 and 5 described below were added thereto over 8 minutes, and residual 10% of Liquids 2 and 3 were added over 2 minutes, so that the nuclear particles were grown to 0.21 μm. Further 0.15 g of potassium iodide was added, and the resulting mixture was ripened for 5 minutes, whereby the particle formation was completed.

| Liquid 4 | |
|---|---|
| Water | 100 ml |
| Silver nitrate | 50 g |
| **Liquid 5** | |
| Water | 100 ml |
| Sodium chloride | 13 g |
| Potassium bromide | 11 g |
| Yellow prussiate of potash | 5 mg |

The resultant was water-washed by a common flocculation method. Specifically, the temperature was lowered to 35° C., the pH was lowered by sulfuric acid until the silver halide was precipitated (within a pH range of 3.6±0.2), and about 3 L of the supernatant solution was removed (first water washing). Further 3 L of a distilled water was added thereto, sulfuric acid was added until the silver halide was precipitated, and 3 L of the supernatant solution was removed again (second water washing). The procedure of the second water washing was repeated once more (third water washing), whereby the water washing and demineralization process was completed. After the water washing and demineralization process, the obtained emulsion was controlled at a pH of 6.4 and a pAg of 7.5. To this were added 100 mg of a stabilizer of 1,3,3a,7-tetraazaindene and 100 mg of an antiseptic agent of PROXEL (trade name, available from ICI Co., Ltd.), to obtain a final emulsion of cubic silver iodochlorobromide particles. The cubic particles contained 70 mol % of silver chloride and 0.08 mol % of silver iodide, and had an average particle diameter of 0.22 μm and a variation coefficient of 9%. The final emulsion had a pH of 6.4, pAg of 7.5, conductivity of 4000 μS/cm, density of $1.4\times10^3$ kg/m$^3$, and viscosity of 20 mPa·s.

[Preparation of Coating Liquid for Emulsion Layer]

$8.0\times10^{-4}$ mol/mol-Ag of the following compound (Cpd-1) and $1.2\times10^{-4}$ mol/mol-Ag of 1,3,3a,7-tetraazaindene were added to the emulsion, and the resultant was well mixed. Then, the following compound (Cpd-2) was added to the mixture to control the swelling ratio if necessary, and the pH of the coating liquid was controlled to 5.6 using citric acid.

Cpd-1

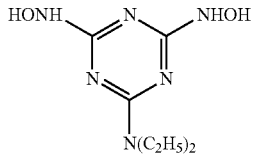

Cpd-2

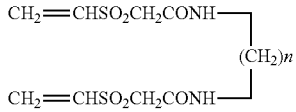

(n = 2):(n = 3) = 3:1

[Support]

A 100-μm-thick PET film having a rectangular shape as viewed from above was used as the support 52. Both surfaces of the support 52 were hydrophilized by a corona discharge treatment.

[Preparation of Photosensitive Film]

The above emulsion layer coating liquid was applied to the above corona-discharge-treated PET film such that the Ag amount was 7.8 g/m$^2$ and the gelatin amount was 1.0 g/m$^2$.

In the obtained photosensitive film, the emulsion layer had a silver/binder volume ratio (silver/GEL ratio (vol)) of 1/1.

[Exposure and Development Treatment]

The above photosensitive film was exposed to a parallel light from a light source of a high-pressure mercury lamp using a photomask having a lattice-patterned space (photomasking line/space=290 μm/10 μm (pitch 300 μm)). The photomask was capable of forming a patterned developed silver image (line/space=10 μm/290 μm). Also an exposure for forming the electrodes 56 was carried out in this step. Thus, a band-like area with a predetermined width on one side was exposed. Then, the exposed film was subjected to a treatment including fixation, water washing, and drying.

(Developer Composition)

The following compounds were contained in 1 L of a developer.

| | |
|---|---|
| Hydroquinone | 15 g/L |
| Sodium sulfite | 30 g/L |
| Potassium carbonate | 40 g/L |
| Ethylenediamine tetraacetic acid | 2 g/L |
| Potassium bromide | 3 g/L |
| Polyethylene glycol 2000 | 1 g/L |
| Potassium hydroxide | 4 g/L |
| pH | Controlled at 10.5 |

(Fixer Composition)

The following compounds were contained in 1 L of a fixer.

| | |
|---|---|
| Ammonium thiosulfate (75%) | 300 ml |
| Ammonium sulfite monohydrate | 25 g/L |
| 1,3-Diaminopropane tetraacetic acid | 8 g/L |
| Acetic acid | 5 g/L |
| Aqueous ammonia (27%) | 1 g/L |
| Potassium iodide | 2 g/L |
| pH | Controlled at 6.2 |

A conductive film 50 having a conductive layer 63 was produced in this manner. The conductive layer 63 contained a thin wiring structure 54 formed in a mesh pattern and a metal portion formed on the one side without openings 60. The conductive layer 63 had a thickness of 0.2 μm and contained thin wires 58 having a line width of 10 μm and a pitch of 300 μm. In addition, the conductive film 50 had a surface resistance value of 25 ohm/sq.

The conductive film 50 was cut into a U shape corresponding to the shape of a toilet seat 16 shown in FIG. 5A, to produce a sample A. The metal portion was left at both ends of the U shape as the electrode 56 for applying a voltage.

<Sample B>

The conductive layer 63 of the sample A was laser-etched to form two U-shaped electrical insulations 64 as shown in FIG. 3A, whereby the thin wiring structure 54 was divided into three regions 66*a*, 66*b*, and 66*c* to produce a sample B. The regions 66*a*, 66*b*, and 66*c* had the same or similar resistance values with a margin of ±15% or less. In the laser etching, a laser light was emitted such that the spot diameter was 10 μm.

(Laser Etching: Processing Apparatus)

Laser: HIPPO532-11W manufactured by Spectra-Physics, Inc.

Galvano-scanner: Product of YE DATA Inc.

fθ lens: F=100

(Processing Condition)

Frequency: 30 kHz

Processing spot output: 140 mW

Scanning speed: 300 mm/sec

Scanning repetition: once

<Sample C>

In the above exposure treatment, the photosensitive film was exposed using a mask having a pattern including the shapes of the mesh and the electrical insulations 64. Then, the photosensitive film was developed, and the resultant conductive film 50 was cut into the U shape to produce a sample C. The sample C had the same structure as the above sample B (see FIG. 3A).

<Sample D>

Liquid 6 was applied to the upper side of the above silver halide emulsion layer at 30 ml/m$^2$ to form a conductive fine particle layer (a layer containing the heat transfer material 68).

| Liquid 6 | |
|---|---|
| Water | 1000 ml |
| Gelatin | 10 g |
| Sb-doped tin oxide SN100P (trade name) available from Ishihara Sangyo Kaisha, Ltd. | 40 g |

A surfactant, an antiseptic agent, and a pH adjuster were further added to Liquid 6 if necessary.

The photosensitive film was exposed and developed in the same manner as the sample A, and then cut into the U shape to produce a sample D (see FIG. 4A). The gelatin had an intrinsic heat transfer coefficient of 0.2 W/m·K, and the tin oxide had an intrinsic heat transfer coefficient of 80 W/m·K.

COMPARATIVE EXAMPLE 1

A product of Comparative Example 1 was produced by attaching a conventional sample containing a nichrome wire and an aluminum foil in combination to a surface opposite to a seating surface (a back surface) of a toilet seat in a conventional manner.

EXAMPLES 1 to 4

The samples A, B, C, and D were each stretched to 110% and formed on the forming mold 74 into a shape corresponding to the toilet seat by a vacuum pressure molding under a load of 80 kg/cm$^2$. Then, products of Examples 1, 2, 3, and 4 were produced by attaching each molded conductive film 50 to the seating surface 16*a* of the toilet seat 16 with the adhesive 62 (OCA: Optical Clear Adhesive).

[Evaluation]

(Interelectrode Resistance)

In Comparative Example 1 and Examples 1 to 4, the resistance value between the electrodes 56 was measured.

(Light Transmittance)

In Examples 1 to 4, the light transmittance of the conductive film 50 having the thin wiring structure 54 was measured.

(Power Consumption and Heating Distribution)

In Comparative Example 1 and Examples 1 to 4, an alternating voltage was applied from the electrodes 56 to the conductive film 50 at the room temperature of 25° C., so that the conductive film 50 was heated. The voltage was controlled such that the conductive film 50 was heated to the same temperature as Comparative Example 1. Then, the heating distribution, the temperature rise time, and the power consumption were measured. The temperature rise time means the time required for rising the surface temperature to a predetermined temperature, which was 14° C. in this example. The heating distribution was taken by Thermovision CPA-7000 manufactured by Chino Corporation when the surface temperature was risen to the predetermined temperature. The temperature was measured by Thermometer CT-30 manufactured by Chino Corporation. The power consumption was measured by Power Hitester 3332 manufactured by Hioki E.E. Corporation.

The evaluation results are shown in Table 3.

TABLE 3

| | Sample | Interelectrode resistance (Ω) | Temperature rise time (second) | Light transmittance (%) | Power consumption (W/m$^2$) | Heating distribution | Number of attaching step |
|---|---|---|---|---|---|---|---|
| Comp. Ex. 1 | — | 200 | 275 | — | 650.0 | Excellent | 2 |
| Ex. 1 | A | 191 | 130 | 84 | 648.2 | Fair | 1 |
| Ex. 2 | B | 192 | 120 | 84 | 649.0 | Excellent | 1 |

TABLE 3-continued

| | Sample | Interelectrode resistance (Ω) | Temperature rise time (second) | Light transmittance (%) | Power consumption ($W/m^2$) | Heating distribution | Number of attaching step |
|---|---|---|---|---|---|---|---|
| Ex. 3 | C | 193 | 120 | 84 | 651.2 | Excellent | 1 |
| Ex. 4 | D | 192 | 100 | 83 | 650.1 | Excellent | 1 |

As shown in Table 3, the interelectrode resistances of Examples 1 to 4 were lower than that of Comparative Example 1. The temperature rise times of Examples 1 to 4 were significantly shorter than that of Comparative Example 1 since the conductive film 50 was attached to the seating surface 16*a* of the toilet seat 16. The product of Example 1 exhibited the temperature rise time of 130 seconds, and both the products of Examples 2 and 3 exhibited the temperature rise time of 120 seconds. The product of Example 4, which contained the heat transfer material 68 in the opening 60, exhibited the temperature rise time of 100 seconds, shorter than those of Examples 2 and 3. The light transmittances of Examples 1 to 4 were 80% or more and thus the films of Examples 1 to 4 were transparent, though only the product of Example 4 exhibited a slightly lowered transmittance because of the heat transfer material 68 contained in the opening 60 of the thin wiring structure 54. The power consumptions were approximately equal in Examples 1 to 4 as well as Comparative Example 1. The heating distributions were approximately uniform in Examples 2 and 3 using the electrical insulations 64 and Example 4 using the heat transfer material 68 in the opening 60, though the product of Example 1 exhibited a nonuniform distribution.

It is clear from the results of Examples 2 and 3 that the advantageous effect of the electrical insulations 64 was such that the regions 66*a*, 66*b*, and 66*c* had approximately the same resistance values, approximately the same current values, and thus approximately the same heat generation amounts. It is believed that the temperature rise times were shortened and the heating distributions were improved by forming the electrical insulations 64.

It is clear from the results of Example 4 that the advantageous effect of the heat transfer material 68 was such that the conductive fine particles (the tin oxide in Example 4) contained in the opening 60 acted to improve the heat transfer because of its heat conductivity higher than that of gelatin. It is believed that the temperature rise time was shorter than those of Examples 2 and 3 and the heating distribution was improved by using the heat transfer material 68.

SECOND EXAMPLE

The pitch of the thin wires 58 in the above sample C was changed to evaluate the variation of the heating distribution.

Examples 11 to 13

Products of Examples 11, 12, and 13 were produced as follows.

In the conductive film 50 of the sample C, the pitch of the thin wires 58 was controlled to 5000, 1000, or 300 μm. Each conductive film 50 was stretched to 115% and formed on the forming mold 74 into a shape corresponding to the toilet seat 16 by a vacuum pressure molding under a load of 80 $kg/cm^2$. Then, products of Examples 11, 12, and 13 were produced by attaching each molded conductive film 50 to the seating surface 16*a* of the toilet seat 16 with the adhesive 62 (OCA). It should be noted that the pitch of Example 13 was equal to that of Example 3.

[Evaluation]

The heating distribution was taken by Thermovision CPA-7000 manufactured by Chino Corporation and evaluated in the same manner as First Example. The evaluation results are shown in Table 4.

TABLE 4

| | Sample | Pitch of thin wires (μm) | Heating distribution |
|---|---|---|---|
| Example 11 | C | 5000 | Excellent |
| Example 12 | C | 1000 | Excellent |
| Example 13 | C | 300 | Excellent |

As shown in Table 4, as long as the pitch of the thin wires 58 was 5000 μm or less, the heating distributions were excellent and not deteriorated.

THIRD EXAMPLE

In Comparative Examples 11 and 12 and Examples 21 to 25, the heat transfer rate of a layer containing a heat transfer material was evaluated. Specifically, the heat transfer coefficient of a mixture of conductive fine particles (silver particles) and a binder (gelatin) was changed, and the heat transfer rate (relative to that of silver) and the light transmittance were measured.

The silver had an intrinsic heat transfer coefficient of 240 W/m·K, and the binder (gelatin) had an intrinsic heat transfer coefficient of 0.2 W/m·K. The volume of the heat transfer material-containing layer was considered as 1, the volume ratios of the conductive fine particles and the binder in the layer were calculated, and the heat transfer coefficient of the mixture in the layer was obtained based on the volume ratios by proportional calculation. Then, the transfer rate of the silver was considered as 10 according to Fourier's law, and the transfer rates (relative ratios) of Comparative Examples 11 and 12 and Examples 21 to 25 were calculated. In addition, also the light transmittances of Comparative Examples 11 and 12 and Examples 21 to 25 were measured. Incidentally, the transfer rate of the gelatin was 1/1000 or less of that of the silver.

The evaluation results are shown in Table 5.

TABLE 5

| | Sample | Conductive fine particles (volume ratio) | Binder (volume ratio) | Transfer coefficient of mixture (W/m · K) | Transfer rate (relative ratio) | Light transmittance (%) |
|---|---|---|---|---|---|---|
| Comp. Ex. 11 | D | 0.02 | 0.98 | 5 | 0.2/10 | 85 |
| Ex. 21 | D | 0.04 | 0.96 | 10 | 1/10 | 84 |
| Ex. 22 | D | 0.21 | 0.79 | 50 | 4/10 | 83 |
| Ex. 23 | D | 0.34 | 0.66 | 80 | 5/10 | 83 |
| Ex. 24 | D | 0.42 | 0.58 | 100 | 6/10 | 82 |
| Ex. 25 | D | 0.63 | 0.37 | 150 | 7/10 | 80 |
| Comp. Ex. 12 | D | 0.84 | 0.16 | 200 | 8/10 | 65 |

As shown in Table 5, the product of Comparative Example 11 had the low transfer rate of 0.2/10, though it had the high light transmittance of 85%. The product of Comparative Example 12 had the low light transmittance of 65% and poor transparency due to a large amount of the conductive fine particles, though it had the high transfer rate of 8/10.

In contrast, the products of Examples 21 to 25 had the light transmittances of 80% or more to exhibit excellent transparencies, and further had the excellent high transfer rates of 1/10 to 7/10.

Thus, it was preferred that the mixture in the heat transfer material-containing layer had a heat transfer coefficient of 10 to 150 W/m·K.

FOURTH EXAMPLE

In samples 1 to 7, whether the conductive film 50 could be stretched or not at a desired stretch ratio under a load in the shaping step was evaluated.

The unshaped conductive film 50 used in the above production of the sample A was cut into a size of 30 mm×100 mm, placed in a universal material testing instrument TENSILON RTF (manufactured by A&D Co., Ltd.), and tensile-stretched in the long axis direction under conditions shown in Table 6. The stretch ratio was obtained by measuring the mesh pitch of the metallic silver portion with a microscope. The stretch property was evaluated by observing whether the conductive film 50 and the conductive layer 63 could be stretched or not at the desired stretch ratio.

TABLE 6

| Sample | Stretch speed (mm/min) | Molding temperature (° C.) | Load (kg/cm$^2$) | Desired stretch ratio (%) | Stretch property | Note |
|---|---|---|---|---|---|---|
| 1 | 1000 | 230 | 5 | 110 | Stretched | Example |
| 2 | 1000 | 230 | 10 | 110 | Stretched | Example |
| 3 | 1000 | 230 | 15 | 110 | Stretched | Example |
| 4 | 1000 | 230 | 50 | 110 | Stretched | Example |
| 5 | 1000 | 230 | 100 | 110 | Stretched | Example |
| 6 | 1000 | 230 | 150 | 110 | Stretched | Example |
| 7 | 1000 | 230 | 235 | 110 | Stretched | Example |

As shown in Table 6, the conductive film 50 could be stretched at the desired stretch ratio under a load of 5 kg/cm$^2$ or more.

FIFTH EXAMPLE

In samples 8 to 36, the relation between the satisfaction of the inequality (I) or (II) and the breakage of the thin wires 58 (the metallic silver portion) was evaluated in the step of shaping the conductive film 50.

The unshaped conductive film 50 used in the above production of the sample A was cut into a size of 30 mm×100 mm, placed in a universal material testing instrument TENSILON RTF (manufactured by A&D Co., Ltd.), and tensile-stretched in the long axis direction under conditions shown in Tables 7 and 8.

The breakage of the metallic silver portion was observed and evaluated using a microscope.

The surface resistivities R1 and R2 were measured at 25° C. and a relative humidity of 45% using LORESTA GP manufactured by Mitsubishi Chemical Analytech Co., Ltd.

Also the satisfaction of the following inequalities (I) and (II) was evaluated. In Tables 7 and 8, each sample were evaluated as Satisfactory when it satisfied the inequality (I) or (II) and evaluated as Unsatisfactory when it did not satisfy the inequality (I) or (II).

$$Y \leq 0.0081X + 0.4286 \quad \text{(I)}$$

$$Y \leq -0.0006Z + 2.3494 \quad \text{(II)}$$

X: Shaping temperature (° C.)

Y: Stretch ratio

Z: Stretch speed (mm/min)

The evaluation results are shown in Tables 7 and 8. The stretch speed, shaping temperature, load, and stretch ratio of each of the samples 8 to 36 are shown in Table 7, and the satisfaction of the inequality (I), the satisfaction of the inequality (II), the breakage of the metallic silver portion, and the R2/R1 ratio of each of the samples 8 to 36 are shown in Table 8.

TABLE 7

| Sample | Stretch speed (Z) (mm/min) | Shaping temperature (X) (° C.) | Load (kg/cm$^2$) | Stretch ratio (Y) (%) |
|---|---|---|---|---|
| 8 | 50 | 80 | 50 | 110 |
| 9 | 50 | 80 | 50 | 128 |
| 10 | 50 | 110 | 50 | 130 |
| 11 | 50 | 110 | 50 | 140 |
| 12 | 50 | 140 | 50 | 140 |
| 13 | 50 | 140 | 50 | 150 |
| 14 | 50 | 140 | 50 | 155 |
| 15 | 50 | 140 | 50 | 170 |
| 16 | 50 | 170 | 50 | 180 |
| 17 | 50 | 170 | 50 | 190 |
| 18 | 50 | 200 | 50 | 205 |
| 19 | 50 | 200 | 50 | 210 |
| 20 | 50 | 230 | 50 | 230 |
| 21 | 50 | 230 | 50 | 240 |
| 22 | 50 | 230 | 50 | 230 |
| 23 | 300 | 230 | 50 | 215 |
| 24 | 300 | 230 | 50 | 220 |
| 25 | 500 | 230 | 50 | 205 |
| 26 | 500 | 230 | 50 | 210 |
| 27 | 600 | 230 | 50 | 200 |
| 28 | 600 | 230 | 50 | 205 |
| 29 | 700 | 230 | 50 | 190 |
| 30 | 700 | 230 | 50 | 200 |
| 31 | 800 | 230 | 50 | 185 |
| 32 | 800 | 230 | 50 | 190 |
| 33 | 900 | 230 | 50 | 175 |
| 34 | 900 | 230 | 50 | 182 |
| 35 | 1000 | 230 | 50 | 170 |
| 36 | 1000 | 230 | 50 | 175 |

TABLE 8

| Sample | Inequality (I) | Inequality (II) | Breakage of metallic silver portion | R2/R1 |
|---|---|---|---|---|
| 8 | Unsatisfactory | Satisfactory | Unbroken | 1.10 |
| 9 | Unsatisfactory | Satisfactory | Broken | ∞ |
| 10 | Satisfactory | Satisfactory | Unbroken | 1.05 |
| 11 | Unsatisfactory | Satisfactory | Broken | ∞ |
| 12 | Satisfactory | Satisfactory | Unbroken | 1.03 |
| 13 | Satisfactory | Satisfactory | Unbroken | 1.10 |
| 14 | Satisfactory | Satisfactory | Unbroken | 1.15 |
| 15 | Unsatisfactory | Satisfactory | Broken | ∞ |
| 16 | Satisfactory | Satisfactory | Unbroken | 1.00 |
| 17 | Unsatisfactory | Satisfactory | Broken | ∞ |
| 18 | Unsatisfactory | Satisfactory | Unbroken | 1.00 |
| 19 | Unsatisfactory | Satisfactory | Broken | ∞ |
| 20 | Unsatisfactory | Satisfactory | Unbroken | 1.04 |
| 21 | Unsatisfactory | Unsatisfactory | Broken | ∞ |
| 22 | Unsatisfactory | Satisfactory | Unbroken | 1.04 |
| 23 | Satisfactory | Satisfactory | Unbroken | 1.05 |
| 24 | Satisfactory | Unsatisfactory | Broken | ∞ |
| 25 | Satisfactory | Unsatisfactory | Unbroken | 1.02 |
| 26 | Satisfactory | Unsatisfactory | Broken | ∞ |
| 27 | Satisfactory | Unsatisfactory | Unbroken | 1.03 |
| 28 | Satisfactory | Unsatisfactory | Broken | ∞ |
| 29 | Satisfactory | Satisfactory | Unbroken | 1.05 |
| 30 | Satisfactory | Unsatisfactory | Broken | ∞ |
| 31 | Satisfactory | Satisfactory | Unbroken | 1.05 |
| 32 | Satisfactory | Unsatisfactory | Broken | ∞ |
| 33 | Satisfactory | Satisfactory | Unbroken | 1.07 |
| 34 | Satisfactory | Unsatisfactory | Broken | ∞ |
| 35 | Satisfactory | Satisfactory | Unbroken | 1.03 |
| 36 | Satisfactory | Unsatisfactory | Broken | ∞ |

It is clear from the results of Tables 7 and 8 that the conductive films 50 having the desired shapes and the low surface resistivities could be produced by the production method of the embodiment. In addition, the breakage of the metallic silver portion was reduced under the condition of one of the above inequalities (I) and (II), and the breakage was not caused under the conditions of both the inequalities (I) and (II). It should be noted that the close contact between the conductive layer 63 and the support 52 was maintained in each shaped conductive film 50.

It is to be understood that the warm toilet seat of the present invention is not limited to the above embodiment, and various changes and modifications may be made therein without departing from the scope of the invention.

What is claimed is:

1. A warm toilet seat comprising a toilet seat having a seating surface, and a transparent seat heater disposed on the seating surface, wherein the seat heater contains a thin wiring structure having a pitch of 5000 μm or less and a heat transfer coefficient κ of 100 W/m·K or more, and a material having a heat transfer coefficient κ of 10 to 150 W/m·K is placed in an opening in the thin wiring structure.

2. The warm toilet seat according to claim 1, wherein the seat heater is used as a heat generator for warming the toilet seat.

3. The warm toilet seat according to claim 1, wherein the seat heater contains a conductive film having the thin wiring structure, and the conductive film is prepared by shaping and stretching to 110% or more an unshaped conductive film.

4. The warm toilet seat according to claim 3, wherein the shaped conductive film is placed on the seating surface of the toilet seat.

5. The warm toilet seat according to claim 3, wherein the conductive film is shaped and placed on the seating surface of the toilet seat by insert molding.

6. The warm toilet seat according to claim 3, wherein the conductive film is prepared by exposing and developing a photosensitive material having a support and a silver halide emulsion layer formed thereon, and the photosensitive material contains a conductive fine particle and a binder in the silver halide emulsion layer or a layer disposed at the silver halide emulsion layer side.

7. The warm toilet seat according to claim 6, wherein the mass ratio of the conductive fine particle to the binder (the conductive fine particle/binder mass ratio) is 1/33 to 5.0/1.

8. The warm toilet seat according to claim 6, wherein the application amount of the conductive fine particle is 10 $g/m^2$ or less.

9. The warm toilet seat according to claim 6, wherein the photosensitive material contains the conductive fine particle and the binder in a layer adjacent to the silver halide emulsion layer.

10. A warm toilet seat comprising a toilet seat having a seating surface, and a transparent seat heater disposed on the seating surface, wherein the seat heater contains a thin wiring structure having a pitch of 5000 μm or less, the thin wiring structure is divided into a plurality of regions by an electrical insulation, and the regions each have a shape corresponding to the shape of the seating surface and have the same or similar resistance values with a margin of ±15% or less between feeding electrodes.

11. The warm toilet seat according to claim 10, wherein the electrical insulation is formed by laser-etching the thin wiring structure.

12. The warm toilet seat according to claim 10, wherein the thin wiring structure is prepared by exposing and developing a photosensitive material having a support and a silver halide emulsion layer formed thereon, the thin wiring structure is divided into the regions by laser etching, and the regions have the same or similar resistance values with a margin of ±15% or less between feeding electrodes.

13. The warm toilet seat according to claim 10, wherein the electrical insulation is formed in the process of preparing the thin wiring structure.

14. The warm toilet seat according to claim 10, wherein the electrical insulation is formed by cutting a conductive film having a support and the thin wiring structure formed thereon.

15. The warm toilet seat according to claim 10, wherein the electrical insulation is formed by making a hole in the thin wiring structure.

16. The warm toilet seat according to claim 10, wherein the seat heater contains a conductive film having the thin wiring structure, and the conductive film is prepared by shaping and stretching to 110% or more an unshaped conductive film.

17. The warm toilet seat according to claim 10, wherein the thin wiring structure is prepared by exposing and developing a photosensitive material having a support and a silver halide emulsion layer formed thereon, the thin wiring structure is divided into the regions having the same or similar resistance values with a margin of ±15% or less between feeding electrodes.

18. The warm toilet seat according to claim 10, wherein the seat heater is used as a heat generator for warming the toilet seat.

19. The warm toilet seat according to claim 10, wherein the seat heater has a light transmittance of 70% or more.

20. The warm toilet seat according to claim 16, wherein the shaped conductive film is placed on the seating surface of the toilet seat.

21. The warm toilet seat according to claim 16, wherein the conductive film is shaped and placed on the seating surface of the toilet seat by insert molding.

22. The warm toilet seat according to claim 1, wherein the seat heater has a light transmittance of 70% or more.

* * * * *